US007470869B2

(12) United States Patent
Lin

(10) Patent No.: US 7,470,869 B2
(45) Date of Patent: Dec. 30, 2008

(54) KEY STRUCTURE

(75) Inventor: Tzu-Chih Lin, Hsinchu County (TW)

(73) Assignee: Altek Corporation, Hsinchu (TW)

( * ) Notice: Subject to any disclaimer, the term of this patent is extended or adjusted under 35 U.S.C. 154(b) by 80 days.

(21) Appl. No.: 11/636,602

(22) Filed: Dec. 11, 2006

(65) Prior Publication Data

US 2008/0023311 A1 Jan. 31, 2008

(30) Foreign Application Priority Data

Jul. 26, 2006 (TW) ..... 95213165 U

(51) Int. Cl.
*H01H 3/12* (2006.01)

(52) U.S. Cl. ..... 200/341; 200/314

(58) Field of Classification Search ..... 200/310–314, 200/341–345, 512–520, 5 A, 406
See application file for complete search history.

(56) References Cited

U.S. PATENT DOCUMENTS 6,844,508 B2 * 1/2005 Lim ..... 200/5 A
6,909,063 B2 * 6/2005 Nam ..... 200/406
6,967,300 B1 * 11/2005 Mizuno et al. ..... 200/512
7,043,042 B2 * 5/2006 Huang et al. ..... 381/334
7,064,288 B2 * 6/2006 Nam ..... 200/406
7,199,321 B1 * 4/2007 Huang ..... 200/406
7,217,893 B1 * 5/2007 Huang et al. ..... 200/1 B
7,238,896 B2 * 7/2007 Nakayama et al. ..... 200/10
7,271,360 B2 * 9/2007 Kobayashi ..... 200/314
7,301,113 B2 * 11/2007 Nishimura et al. ..... 200/406
7,340,273 B2 * 3/2008 Ono ..... 455/550.1
7,345,250 B2 * 3/2008 Hakunti et al. ..... 200/5 A

* cited by examiner

*Primary Examiner*—Michael A Friedhofer
*Assistant Examiner*—Lisa N Klaus
(74) *Attorney, Agent, or Firm*—Birch, Stewart, Kolasch & Birch, LLP

(57) ABSTRACT

A key structure is provided, which includes a plurality of contact members and a control member. Each of the contact members has an elastic portion and a fixed portion, and the control member has a pressing portion and a combining portion. The control member is selectively combined with an appropriate contact member according to actual requirements in the electrical connection.

6 Claims, 7 Drawing Sheets

F1G.1A
(PRIOR ART)

KEY STRUCTURE

CROSS-REFERENCE TO RELATED APPLICATIONS

This non-provisional application claims priority under 35 U.S.C. §119(a) on Patent Application No(s). 095213165 filed in Taiwan, R.O.C. on Jul. 26, 2006,the entire contents of which are hereby incorporated by reference.

BACKGROUND OF THE INVENTION

1.Field of Invention

The present invention relates to a key structure, and more particularly, the present invention relates to a key structure outputting a signal with a control member through contact members combined with the control member.

2.Related Art

Key structures are required in consumer electronics in daily life and in large industrial processing equipments as the media to control the electronics and processing equipments. Conventional key structures are normally classified into dome switches and rubber switches.

FIG. 1A is a schematic stereogram of a dome switch according to the prior art. A metal dome 11 is disposed on an electric contact 31 of a circuit board 30. When a user presses a key 12, it is pressed against the metal dome 11 so as to be in electrical contact with the electric contact 31 to output a corresponding signal. The key 12 then returns to its original position with the elastic force of the metal dome 11 after the pressure on the key 12 is released.

FIG. 1B is a schematic stereogram of a rubber switch according to the prior art. A plurality of keys 21 is arranged into a module with fixed intervals by a rubber material 20. A conductive rubber 22 is disposed on one end of a key 21 corresponding to an electric contact 31. When the key 21 is pressed, the conductive rubber 22 of the key 21 is in electrical contact with the electric contact 31 to output a corresponding signal. Then the key 21 turns to its original position with the elastic force of the rubber material 20.

As shown in FIG. 1A, the conventional dome switch has to use a transparent thin film 13 to attach the metal dome 11 on the electric contact 31, so as to prevent the situation that the key 12 cannot be in electrical contact with the electric contact 31 through the metal dome 11 as the metal dome 11 leaves the corresponding position of the electric contact 31 due to external force. After having been used for a long time, the functionality of the transparent thin film 13 may get lost because of the deterioration of the material, which leads to lower accuracy during the aligning of the metal dome 11. Furthermore, the application of the transparent thin film 13 incurs additional manufacturing cost.

As shown in FIG. 1B, the rubber module applied in the conventional rubber switch occupies too much space during the assembling, thus the positions for other electronic components are limited, which doesn't comply with the requirements that electronic devices shall be light and thin currently. Furthermore, the rubber material 20 for fabricating the rubber switch module also constitutes a burden to the manufacturers.

SUMMARY OF THE INVENTION

Accordingly, the object of the present invention is to provide a key structure, which eliminates the limitations or defects of over high manufacturing cost and too much space occupied by the key switches of the prior art.

To achieve the aforementioned object, the key structure of the present invention comprises a plurality of contact members and a control member. Each of the contact members has an elastic portion and a fixed portion, and the control member has a pressing portion and a combining portion. The combining portion of the control member is combined to the fixed portion of the contact member.

The function of the present invention is that the control member can be selectively disposed on different types of contact members according to the electrical requirements in actual applications, such that the objects of simple and fast assembling, significantly reduced occupied space, and lower manufacturing cost are achieved.

The summary of the content of the present invention above and the description of the embodiment below are to illustrate and explain the principle of the present invention, and to provide further explanation of the claims of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein:

FIG. 1A is a schematic stereogram of a dome switch according to the prior art.

DETAILED DESCRIPTION OF THE INVENTION

Figure 1B:
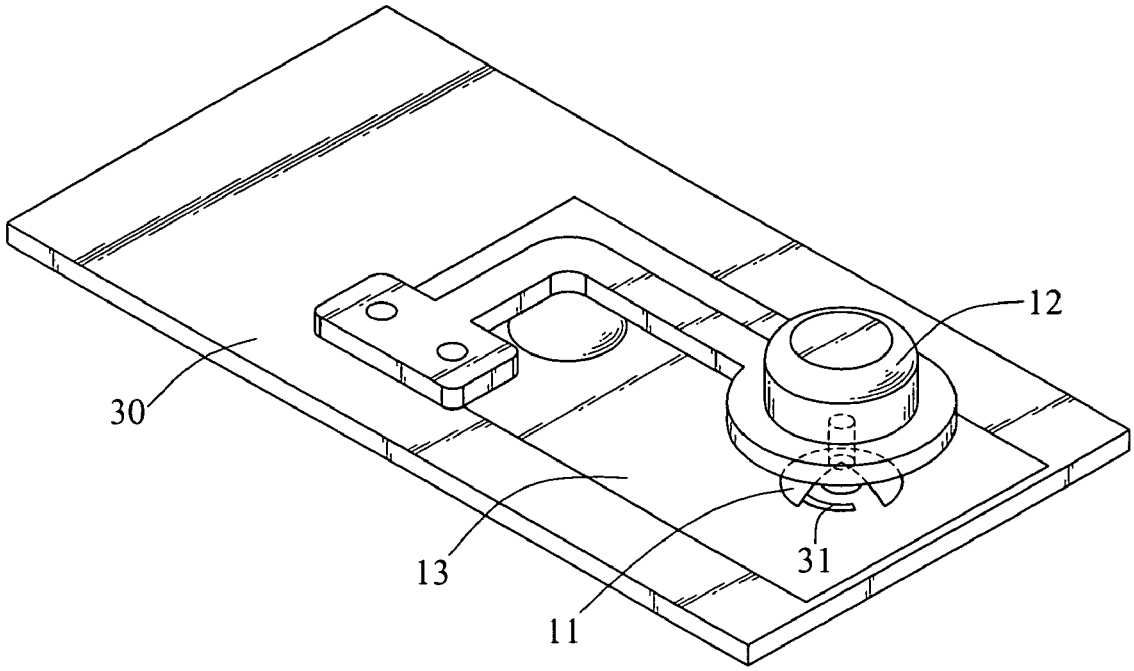
FIG.1B (PRIOR ART)
FIG. 1B is a schematic stereogram of a rubber switch according to the prior art.
Figure 1B:
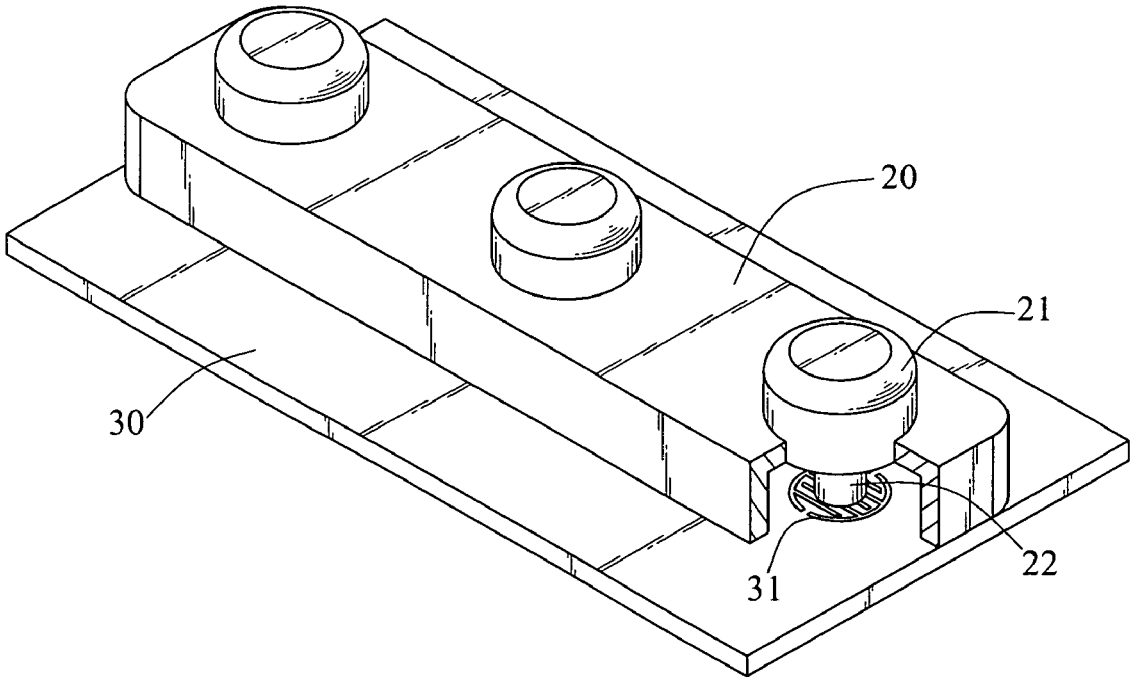
FIG.1B (PRIOR ART)

To make the object, structure, features, and functions of the present invention more comprehensible, the present invention is illustrated in detail below with reference to the embodiments.

FIG. 2A to FIG.3B are schematic stereograms of the first embodiment and the second embodiment of the present invention. As shown in the figures, the key structure 100 disclosed in the present invention is disposed on a circuit board 300 that having at least one contact 310. The key structure 100 includes a plurality of contact members 110 and a control member 120. Each of the contact members 110 has an elastic portion 111 and a fixed portion 112, and the control member 120 has a pressing portion 121 and a combining portion 122, wherein the combining portion 122 is combined in the fixed portion 112 such that the control member 120 and the contact members 110 are combined with each other. Through the elastic feature of the contact member 110, the control member 120 has a release position where it is normally spaced at a fixed interval with an electric contact 310, and has a contact position where it is in electrical contact with the electric contact 310. The control member 120 is made of a plastic material, and the pressing portion 121 is an arched structure to facilitate the user's pressing on the control member 120. The combining portion 122 extends from one end of the pressing portion 121 and forms a pin structure, and is combined in the fixed portion 112 of the contact member 110, so as to be in electrical contact with the electric contact 310.

Figure 2A:
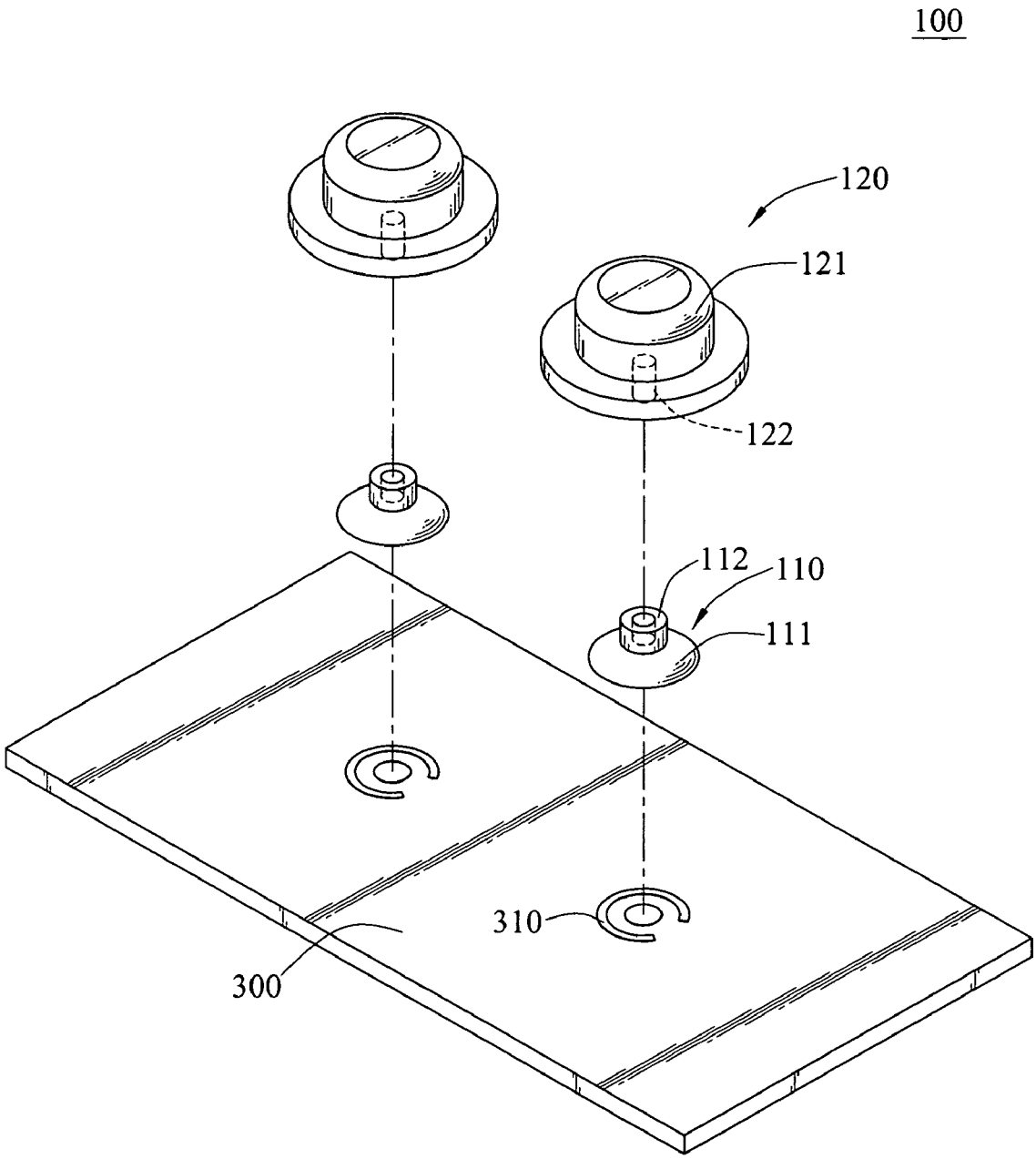
FIG. 2A is a schematic exploded view of the first embodiment of the present invention.
Figure 2B:
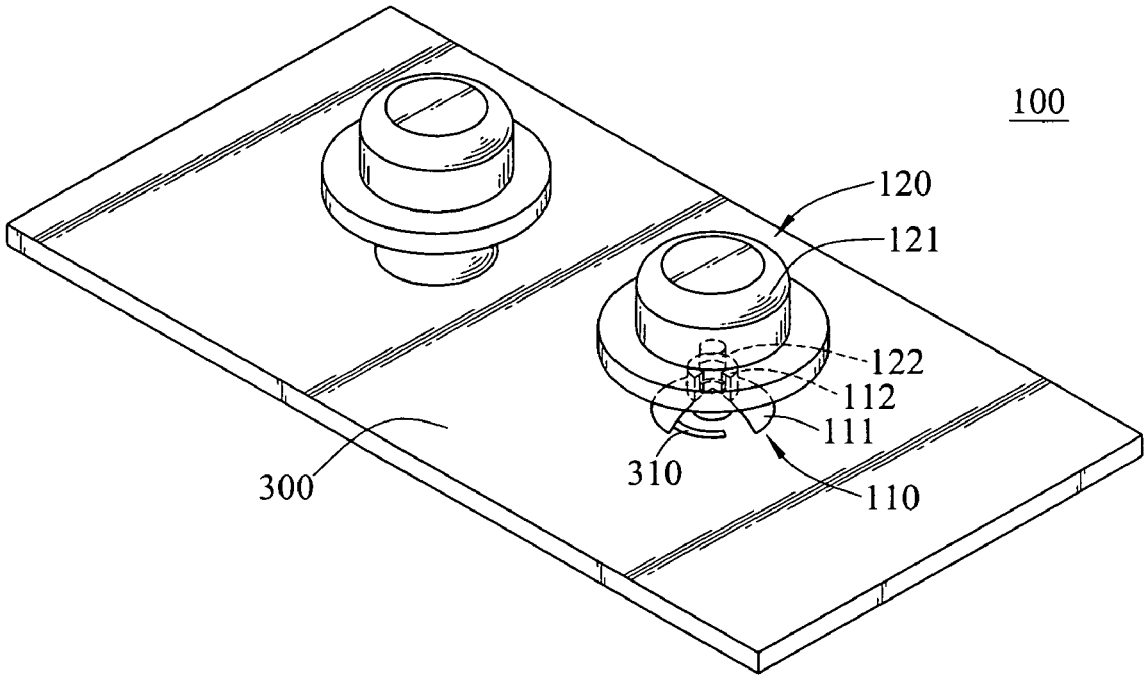
FIG. 2B is a schematic stereogram of the first embodiment of the present invention.

As shown in FIG. 2A and FIG. 2B, the first embodiment of the present invention discloses the implementation of a dome switch. As shown in the figures, the elastic portion 111 of the contact member 110 is a metal dome. When the user presses the control member 120, the metal dome is pushed to be in electrical contact with the electric contact 310 to output a corresponding signal. When the user releases the control member 120, the combining portion 122 combined in the fixed portion 112 returns to the release position with the elastic force of the elastic portion 111 of the contact member 110, that is, the control member 120 is suspended at a corresponding position of the electric contact 310. As the control member 120 is directly disposed on the contact member 110, the uniformity of the dome switch when exerting a force is improved, thus the limitation of low aligning performance of the conventional dome switch is prevented.

Figure 3A:
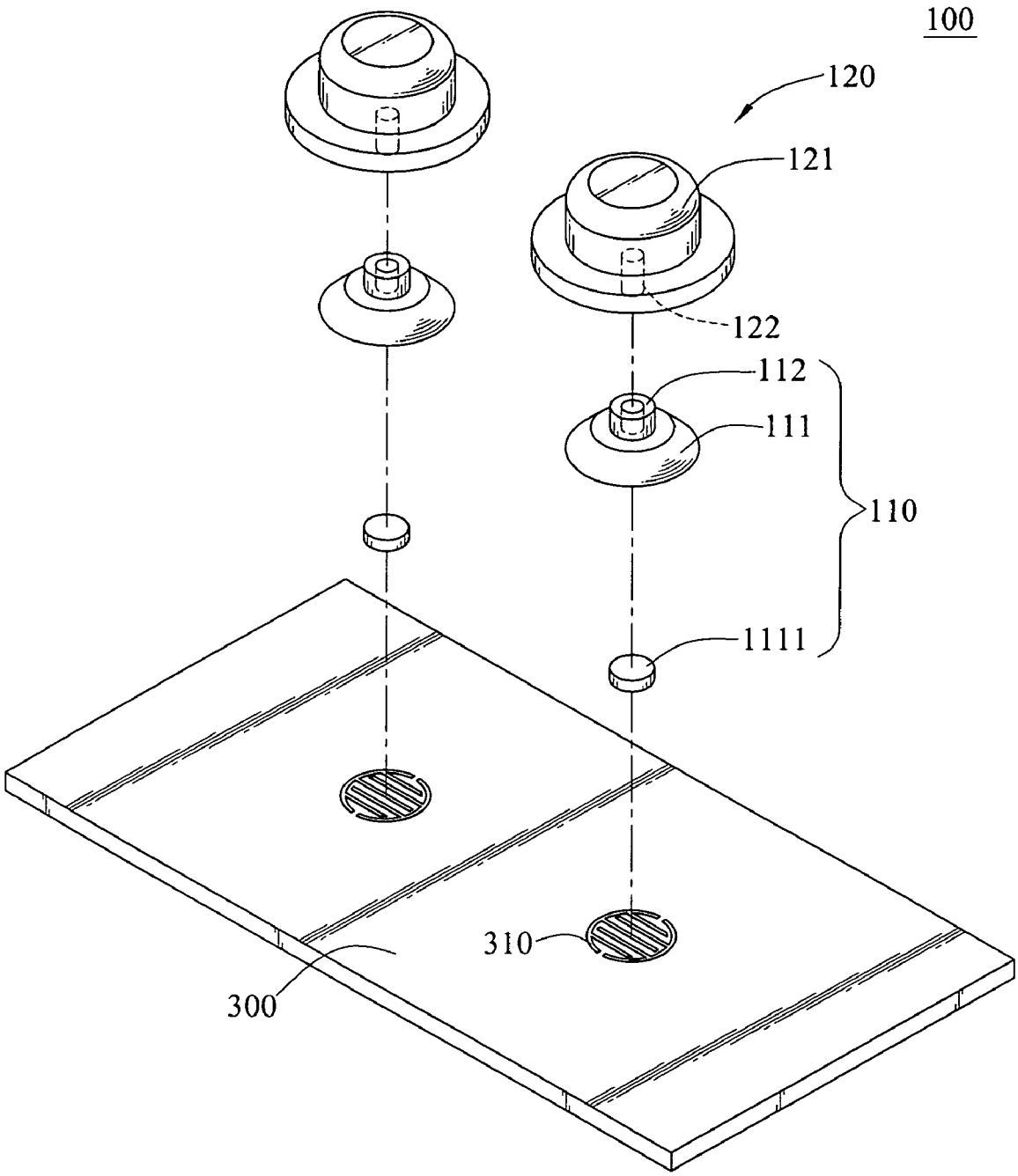
FIG. 3A is a schematic exploded view of the second embodiment of the present invention.
Figure 3B:
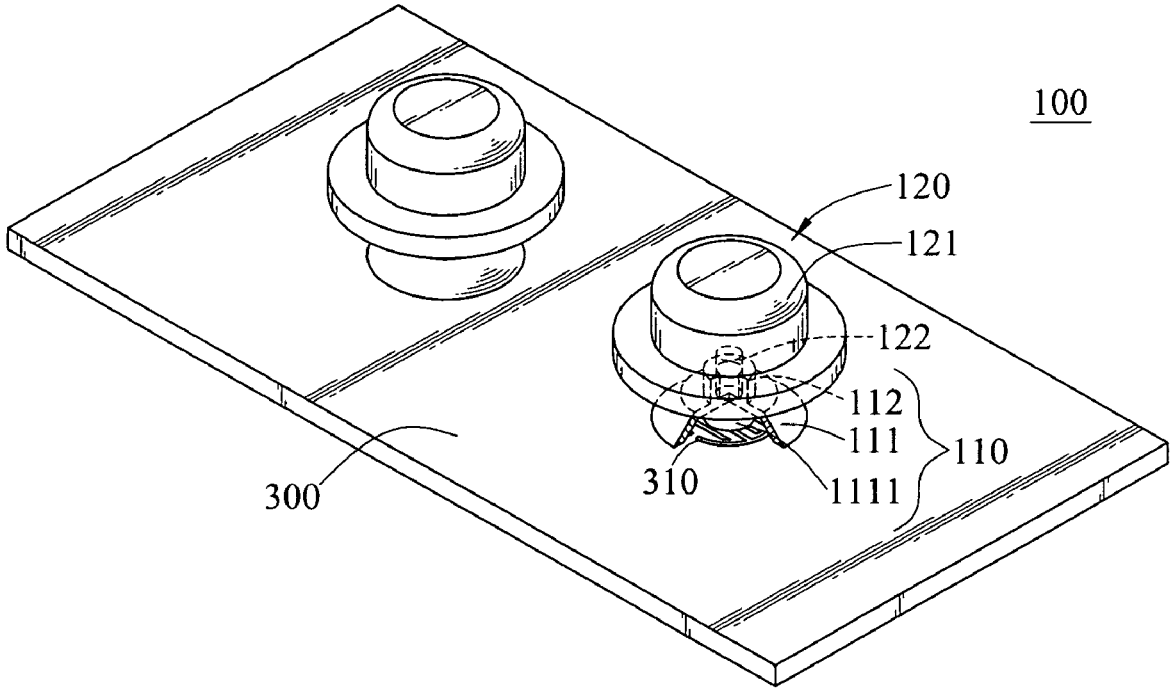
FIG. 3B is a schematic stereogram of the second embodiment of the present invention.

As shown in FIG. 3A and FIG. 3B, the second embodiment of the present invention discloses the implementation of a rubber switch. As shown in the figures; the elastic portion 111 of the contact member 110 is made of a rubber material, and a conductive rubber 1111 is disposed in the elastic portion 111. When the user presses the control member 120, the conductive rubber 1111 is pushed to be in electrical contact with the electric contact 310 to output a corresponding signal. When the user releases the control member 120, the combining portion 122 combined in the fixed portion 112 returns to the release position because of the elastic feature of the elastic portion 111, that is, the control member 120 is suspended at a corresponding position of the electric contact 310.

Figure 4A:
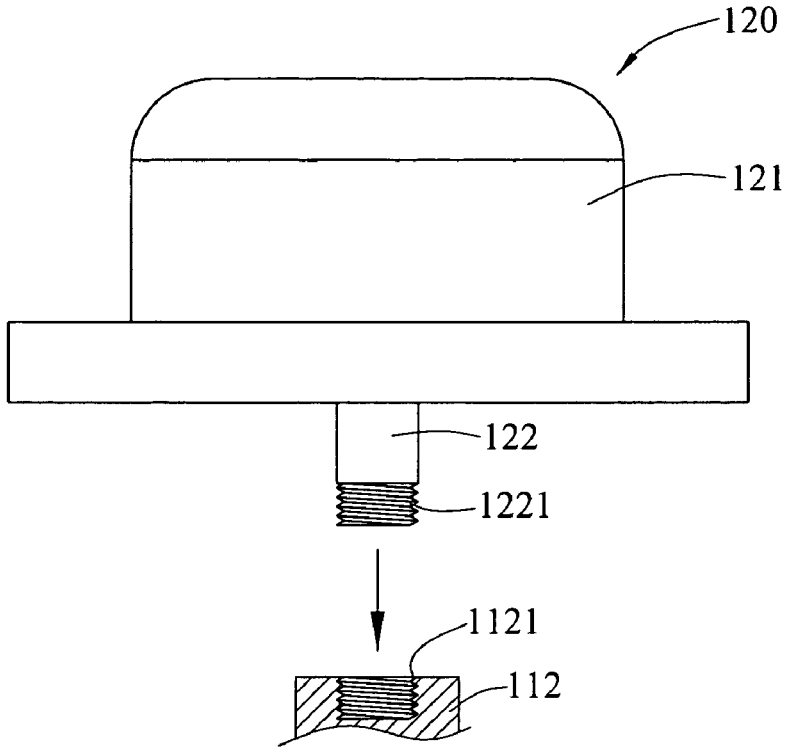
FIG. 4A is a schematic exploded view of the combining aspect of the control member and the contact member of the present invention.
Figure 4B:
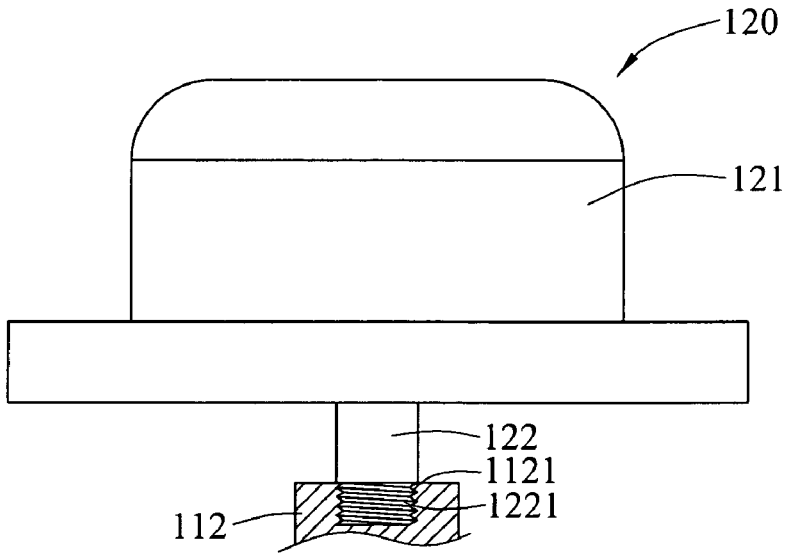
FIG. 4B is a schematic combined view of the combining aspect of the control member and the contact member of the present invention.

As shown in FIGS. 4A and 4B, the combining of the contact member 110 and the control member 120 can be realized by screw thread fitting. The combining portion 122 of the control member 120 has an external thread 1221, and the fixed portion 112 of the contact member 110 has an internal thread 1121 that matching with the external thread 1221. The user can selectively combine the combing portion 122 of the control member 120 and the fixed portion 112 of an appropriate contact member 110 by means of locking according to actual requirements.

Figure 5A:
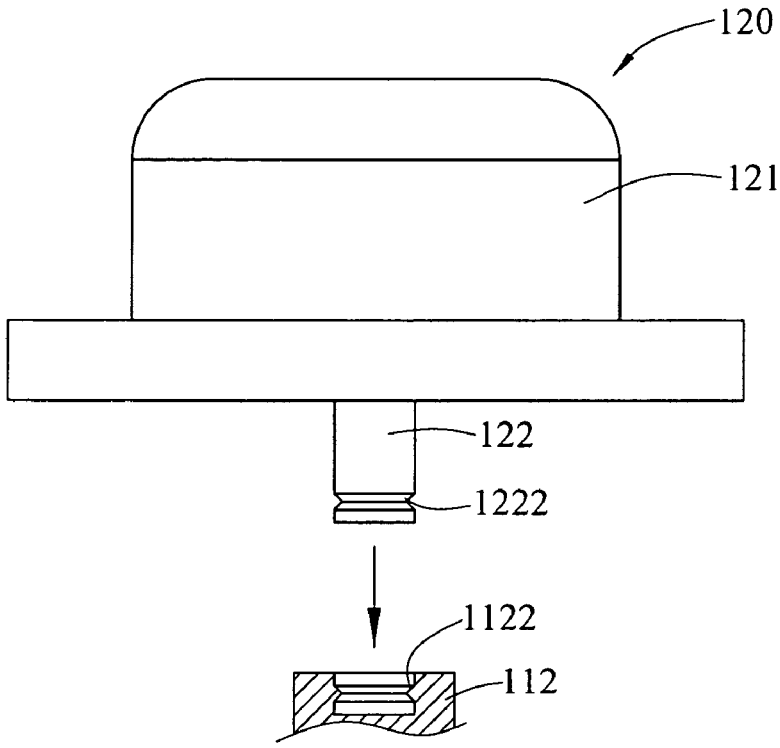
FIG. 5A is a schematic exploded view of the combining aspect of the control member and the contact member of the present invention.
Figure 5B:
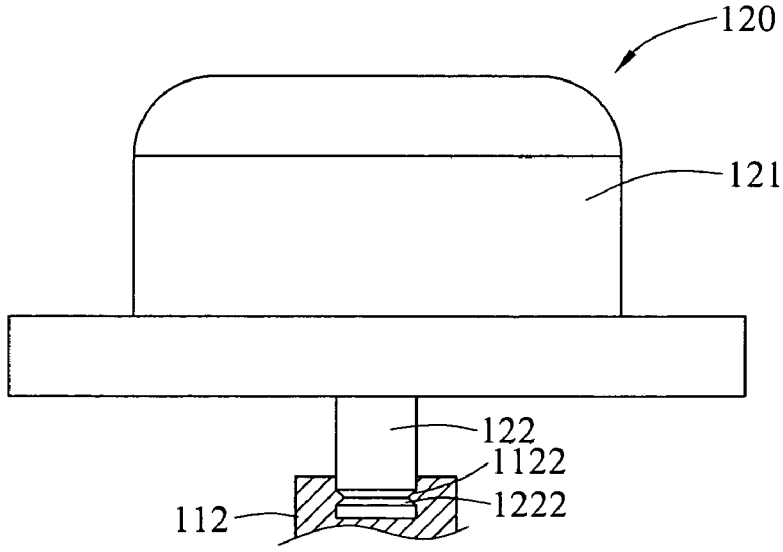
FIG. 5B is a schematic combined view of the combining aspect of the control member and the contact member of the present invention.

As shown in FIG. 5A and FIG. 5B, the combining of the contact member 110 and the control member 120 can be realized by means of engaging. The combining portion 122 of the control member 120 has two opposite engaging grooves 1222, and the fixed portion 112 of the contact member 110 has two protruded ribs 1122 that corresponding to the engaging grooves 1222. The user can selectively buckle the combining portion 122 into the fixed portion 112 according to actual requirements, such that the control member 120 and the contact member 110 are engaged with each other.

The control member of the present invention can be combined with the contact member of an appropriate type according to actual requirements in the electrical connection, such that the objects of fast assembling, significantly reduced occupied space, and lower manufacturing cost are achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A key structure, comprising:

a contact member, having an elastic portion and a fixed portion; and a control member, having a pressing portion and a combining portion, wherein the combining portion has an external thread, and the fixed portion has an internal thread matching with the external thread, such that the combining portion and the fixed portion are combined.

2. The key structure as claimed in claim 1, wherein the elastic portion is a metal dome.

3. The key structure as claimed in claim 1, wherein the elastic portion is a rubber material, and a conductive rubber is disposed in the elastic portion.

4. A key structure, comprising:

a contact member, having an elastic portion and a fixed portion; and a control member, having a pressing portion and a combining portion, wherein the combining portion has an engaging groove, and the fixed portion has a protruded rib, such that the combining portion and the fixed portion are combined.

5. The key structure as claimed in claim 4, wherein the elastic portion is a metal dome.

6. The key structure as claimed in claim 4, wherein the elastic portion is a rubber material, and a conductive rubber is disposed in the elastic portion.

* * * * *